US010844650B2

(12) United States Patent
Edlin et al.

(10) Patent No.: US 10,844,650 B2
(45) Date of Patent: Nov. 24, 2020

(54) EMERGENCY EXIT WINDOW SYSTEM

(71) Applicant: Meshtec International Co., Ltd., Chiang Mai (TH)

(72) Inventors: David Neil Edlin, Chiang Mai (TH); Peter Syme Taylor, Chiang Mai (TH)

(73) Assignee: Meshtec International Co., Ltd., Chiang Mai (TH)

( * ) Notice: Subject to any disclaimer, the term of this patent is extended or adjusted under 35 U.S.C. 154(b) by 121 days.

(21) Appl. No.: 16/164,448

(22) Filed: Oct. 18, 2018

(65) Prior Publication Data

US 2019/0119953 A1 Apr. 25, 2019

Related U.S. Application Data

(60) Provisional application No. 62/575,279, filed on Oct. 20, 2017.

(51) Int. Cl.
*E06B 3/36* (2006.01)
*E05B 65/10* (2006.01)
(Continued)

(52) U.S. Cl.
CPC ..... *E06B 3/36* (2013.01); *E05B 65/1033* (2013.01); *E05B 65/1093* (2013.01); *E05C 3/14* (2013.01);
(Continued)

(58) Field of Classification Search
CPC ..... E05B 65/1033; E05B 65/0014; E05B 65/1093; E06B 3/325; E06B 3/308; E06B 3/36; E06B 9/02; E05C 3/14
See application file for complete search history.

(56) References Cited

U.S. PATENT DOCUMENTS 1,919,418 A * 7/1933 Dudley ..... E06B 3/325 49/192
3,994,093 A * 11/1976 Mayer ..... E05D 15/52 49/192
(Continued)

OTHER PUBLICATIONS

Intellectual Property India; App. No. 201814039571; Examination report under sections 12 & 13 of the Patents Act, 1970 and the Patents Rules, 2003; dated Feb. 28, 2020.
(Continued)

*Primary Examiner* — Justin B Rephann
(74) *Attorney, Agent, or Firm* — Fitch, Even, Tabin & Flannery LLP

(57) ABSTRACT

There are provided emergency exit window systems. In one form, there is provided an emergency exit window system that includes: a frame; a sash pivotally carried by the frame so as to pivot between a closed position in which the sash is flush with the frame, and an open position permitting human egress through the frame; and a locking mechanism adapted for locking the window sash in the closed position. The locking mechanism may include a locking arm movably carried by the sash, wherein the locking arm is movable relative to the sash between a lock position and an unlock position. Further, the locking mechanism may include at least one biasing member acting between the locking arm and the sash to bias the locking arm toward the lock position; an inwardly projecting locking catch fixedly carried by the frame; and an inwardly projecting safety guard movably carried by the frame.

6 Claims, 6 Drawing Sheets

(51) Int. Cl.
*E05C 3/14* (2006.01)
*E05B 65/00* (2006.01)

(52) U.S. Cl.
CPC ..... *E05B 65/0014* (2013.01); *E05Y 2900/148* (2013.01)

(56) References Cited

U.S. PATENT DOCUMENTS 4,420,905 A * 12/1983 Kucharczyk ..... E05C 9/002 292/139
5,556,141 A * 9/1996 Rogers ..... E05B 65/0014 292/303
5,893,600 A * 4/1999 McManus ..... B60J 1/001 296/146.16
6,094,865 A * 8/2000 Weeks ..... E06B 9/17046 160/290.1
6,216,401 B1 * 4/2001 Emek ..... E06B 1/6046 49/322
6,502,356 B2 * 1/2003 Emek ..... E06B 1/6046 49/322
6,634,681 B1 10/2003 Redden
7,574,773 B2 * 8/2009 Dahl ..... E05D 1/04 16/231
8,418,404 B2 4/2013 Gramstad et al.
8,490,330 B2 7/2013 Lund et al.
8,910,424 B2 * 12/2014 Harris ..... E05B 65/1033 49/394
2003/0079414 A1 * 5/2003 Rangabasyam ..... E06B 3/20 49/395
2009/0109575 A1 * 4/2009 McCoy-Deedler ..... E05B 47/0038 360/256.2
2012/0312484 A1 * 12/2012 Harris ..... E05B 65/1033 160/218

OTHER PUBLICATIONS

Obhan & Associates; App. No. 201814039571; Response As Filed to First Examination Report; dated May 20, 2020.

* cited by examiner

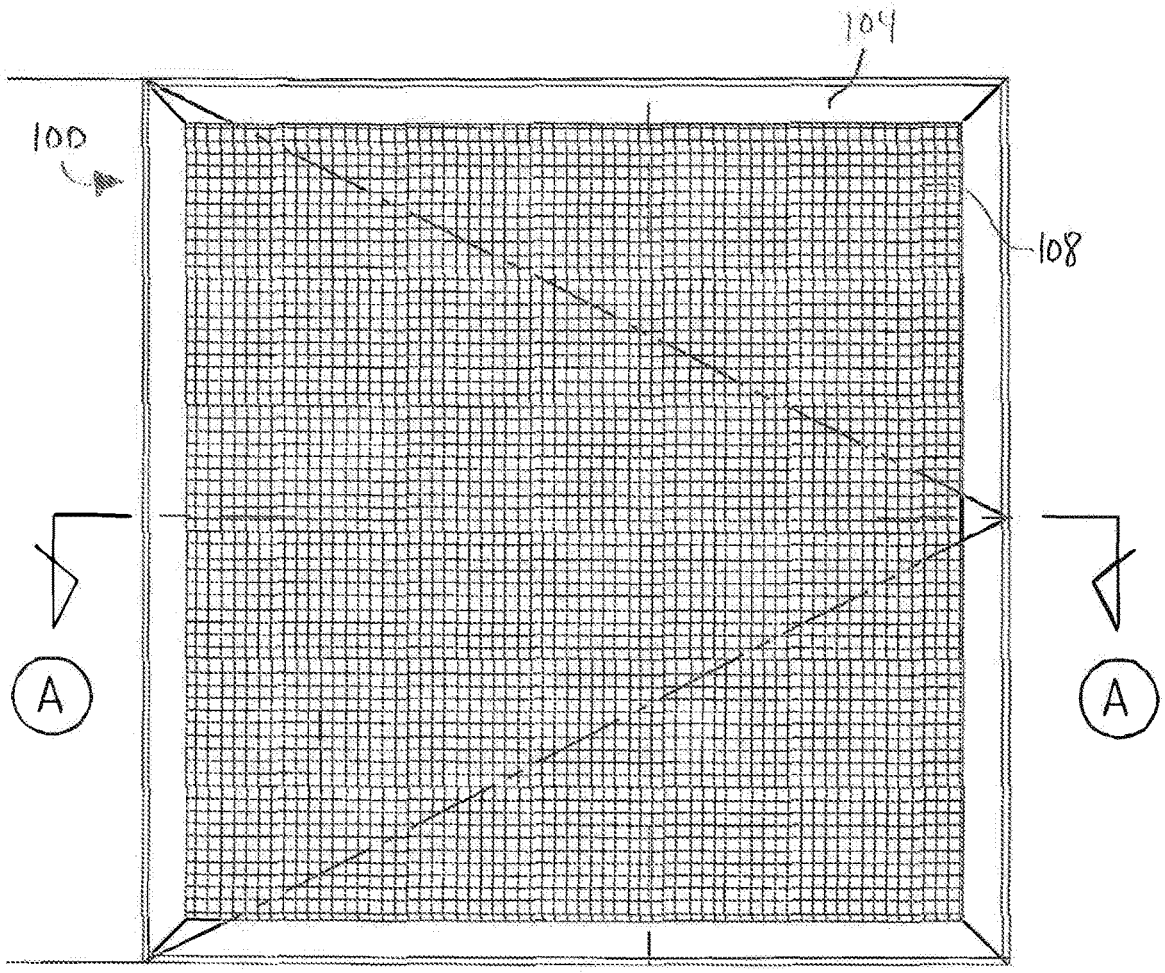
FIG. 2
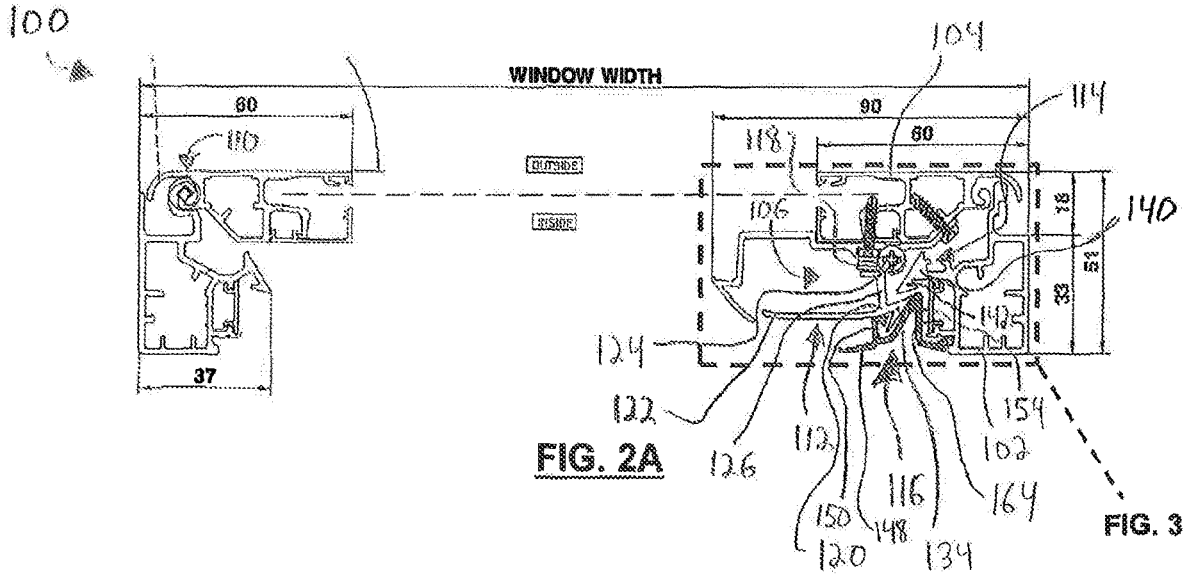
FIG. 2A
FIG. 3

EMERGENCY EXIT WINDOW SYSTEM

CROSS-REFERENCE TO RELATED APPLICATION

This application claims the benefit of U.S. Provisional Application No. 62/575,279, filed Oct. 20, 2017, which is incorporated by reference in its entirety herein.

TECHNICAL FIELD

The present invention relates to window egress systems, and more particularly to child safety mechanisms for window egress systems.

BACKGROUND

Some types of windows are designed to function as an emergency exit, for example in case of fire. While such a window may be a lifesaving portal to safety in case of a conflagration, they can also open the way to tragedy, since they pose a risk that a young child may fall through the escape opening. To guard against this risk, ASTM 2090 provides that the emergency escape release mechanism for such a window must require two distinct actions to operate, in addition to the action of opening the fall prevention screen or window guard.

One approach is to provide a spring-mounted locking arm on the window sash that cooperates with a locking catch on the window frame, with a safety catch being pivotally mounted on the frame. The safety catch can pivot between an engaged position in which the safety catch obstructs movement of the locking arm and a disengaged position in which the safety catch permits the locking arm to move away from the locking catch and release the window sash to open. A problem with this arrangement, however, is that if the window is opened, the safety catch may remain in the disengaged position even after the window is closed.

SUMMARY

The present disclosure describes an emergency exit window system in which, when the sash is moved to the closed position, the locking arm is placed in the lock position and a safety guard is placed in the engaged position so as to secure the locking arm in the lock position, regardless of whether the safety guard started out in the engaged position or the disengaged position when the sash was closed.

BRIEF DESCRIPTION OF THE DRAWINGS

These and other features of the invention will become more apparent from the following description in which reference is made to the appended drawings wherein:

FIG. 2 is a rear (exterior) side elevation view of the exemplary emergency exit window system of FIG. 1;

FIG. 2A is a cross-sectional view taken along the line A-A in FIG. 2;

DETAILED DESCRIPTION

Figure 1:
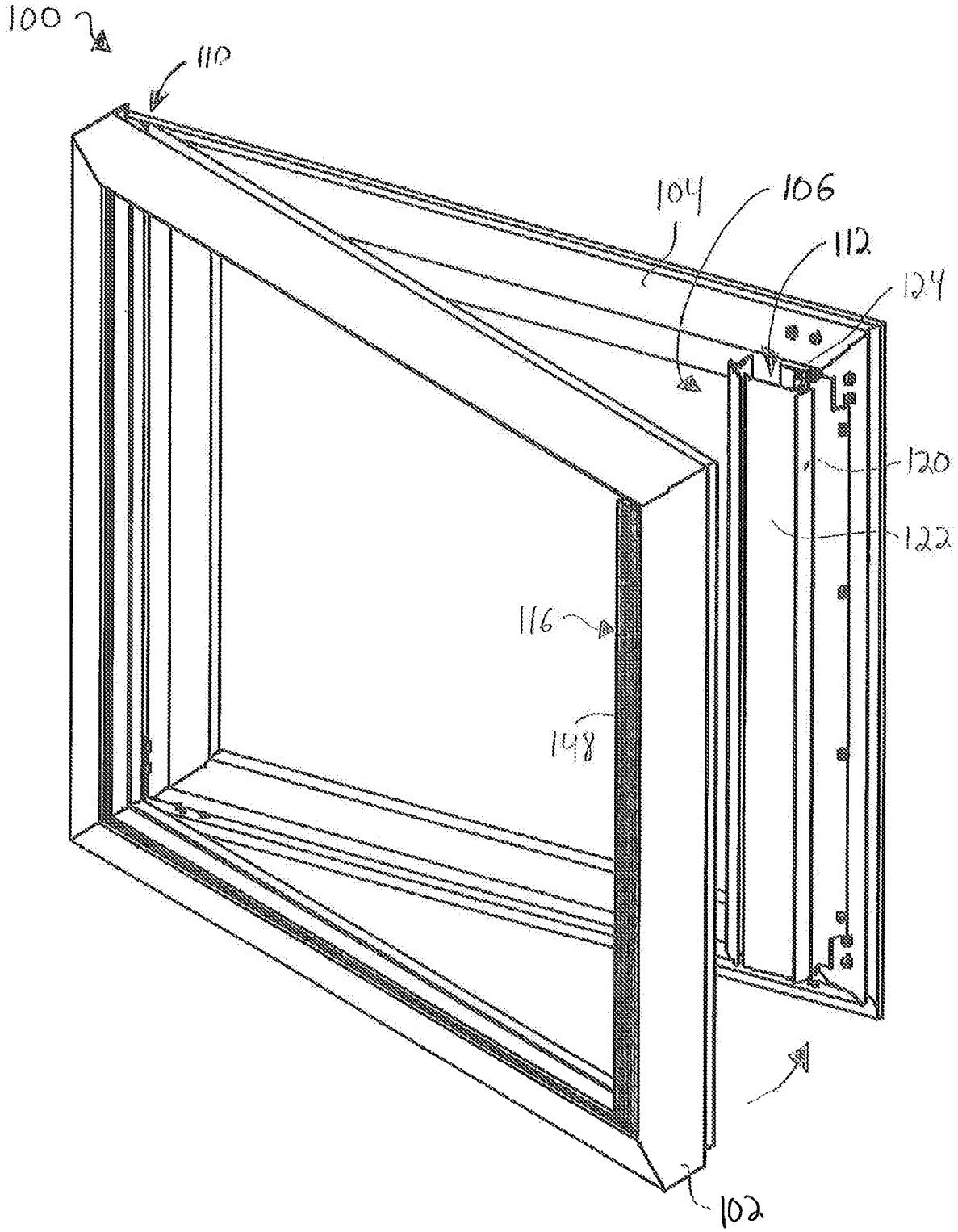
FIG. 1 is a top perspective view of an exemplary emergency exit window system according to an aspect of the present disclosure.

Reference is first made to FIGS. 1 to 2A, in which an exemplary emergency exit window system is indicated generally by reference 100. The window system 100 is shown in a side hung configuration for purposes of illustration; window systems according to the present disclosure are not limited to the side hung configuration. It will be appreciated that the term "window system" does not require the use of a glass pane, and other suitable materials, such as polycarbonate, composites and laminates may also be used. Moreover, a grill or mesh of suitable strength may span the window, either in addition to or as an alternative to a pane.

The window system 100 comprises a frame 102, a sash 104, and a locking mechanism 106, and as can be seen in FIG. 2, in the illustrated embodiment a suitable protective mesh 108 extends across the sash 104. In describing the window system 100, the terms "inwardly", "outwardly", "interiorly" and "exteriorly" will be used. The terms "inwardly" and "outwardly", as used in reference to the frame 102 and sash 104, are intrinsic directions that are generally defined by the frame 102 and sash 104. The term "inwardly" refers to the direction toward the region surrounded by the frame 102 and sash 104 and "outwardly" is the opposite; i.e. away from the region surrounded by the frame 102 and sash 104, and the terms "inner" and "outer" have corresponding meanings. The terms "interiorly" and "exteriorly", as used in reference to the frame 102 and sash 104, are extrinsic references. "Interiorly" refers to a direction toward the interior of a structure in which the window system 100 is to be installed, and "exteriorly" conversely refers to a direction toward the exterior of that structure; the terms "interior" and "exterior" have corresponding meanings. It is intended that the frame 102 be fixed in a structure such as a building.

The sash 104 is pivotally carried by the frame 102 so as to pivot between a closed position in which the sash is flush with the frame, as shown in FIGS. 2A, 5A, 6D and 7F, and an open position in which the sash 104 is pivoted exteriorly to permit human egress through the frame 102, for example to escape from a fire. The sash 104 is pivotally coupled to the frame 102 by a hinge 110; any suitable hinging mechanism may be used and hence the hinge 110 is not described further. The locking mechanism 106 is adapted for locking the window sash 104 in the closed position.

Figure 3:
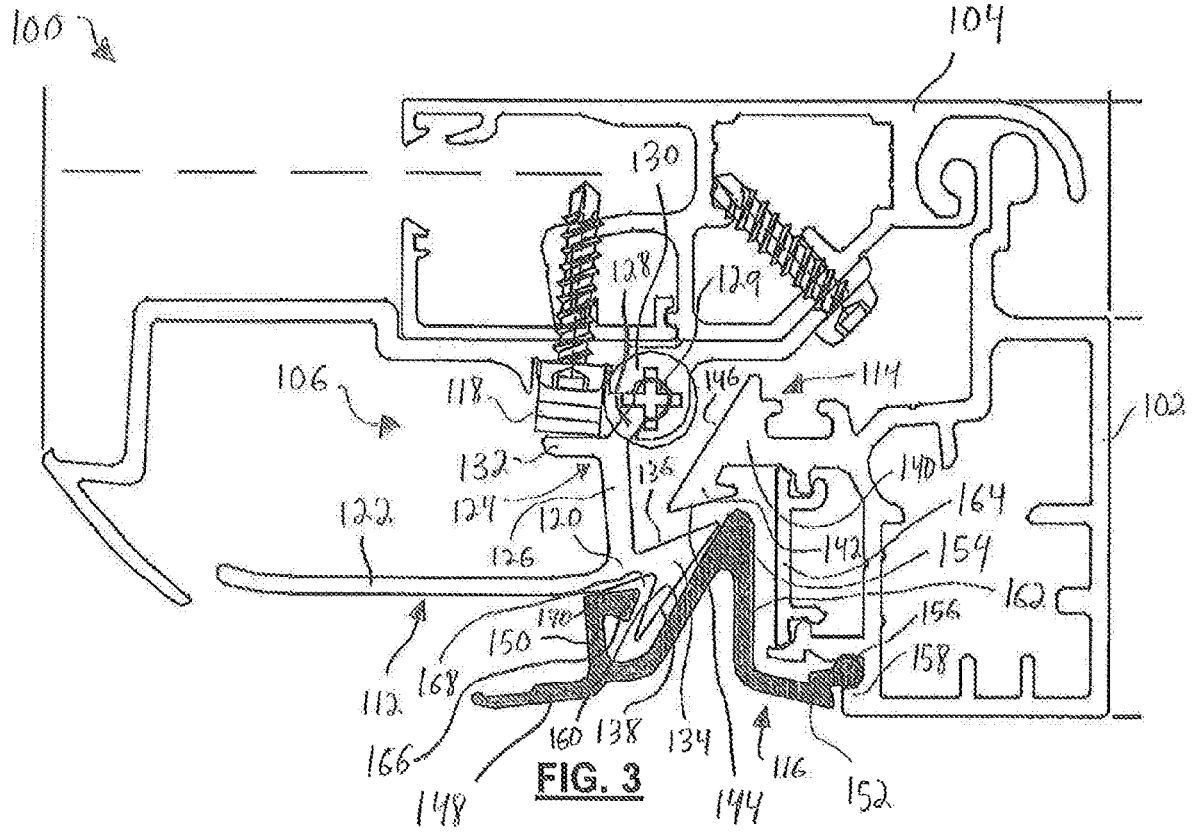
FIG. 3 is a detailed view of a portion of FIG. 2.

Referring now to FIG. 3, in the illustrated embodiment the locking mechanism 106 comprises a locking arm 112 movably carried by the sash 104, an inwardly projecting locking catch 114 fixedly carried by the frame 102 and an inwardly projecting safety guard 116 movably carried by the frame 102.

The locking arm 112 is movable, in this case pivotable, relative to the sash between a lock position (FIGS. 5A, 6D and 7F) and an unlock position (FIGS. 5B, 6B, 7C), and a biasing member in the form of a spring 118 acts between the locking arm 112 and the sash 104 to bias the locking arm 112 toward the lock position; other biasing arrangements may also be used. The locking arm 112 includes an outwardly directed locking portion 120, an inwardly directed handle portion 122, a hinging portion 124 and a spacer portion 126 extending between the locking portion 120 and the hinging portion 124. The hinging portion 124 includes a pin arm 128 whose terminal hinge pin 129 is pivotally received in a corresponding C-shaped hinge barrel 130 on the sash 104 to allow the locking arm 112 to pivot relative to the sash, and also includes a spring seat 132 on which the spring 118 acts. The locking portion 120 of the locking arm 112 includes a terminal sash detent 134 at its outer (i.e. outwardly facing) end. The sash detent 134 is generally sagittate in cross-section, and has a sash detent engagement surface 136 on an exterior side thereof and has an obliquely angled sash detent guide surface 138 on an interior side thereof.

The locking catch 114 has a locking portion 140 that includes a terminal frame detent 142 at an inner (i.e. inwardly facing) end thereof, and the frame detent 142 has a frame detent engagement surface 144 on an interior side thereof and has a frame detent guide surface 146 on an interior side thereof. The frame detent guide surface 146 is obliquely angled so that its inner end is disposed interiorly of its outer end.

Figure 5A:
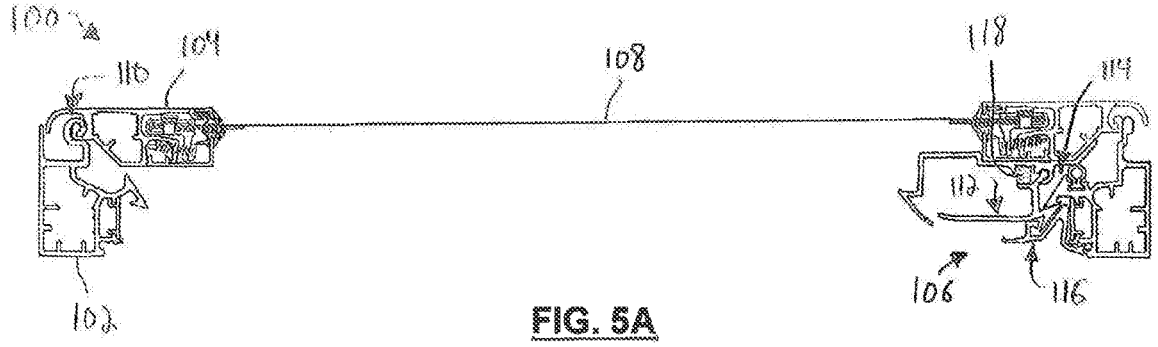
FIGS. 5A to 5D are cross-sectional views similar to that in FIG. 2A, showing opening of the emergency exit window system of FIG. 1.
Figure 5C:
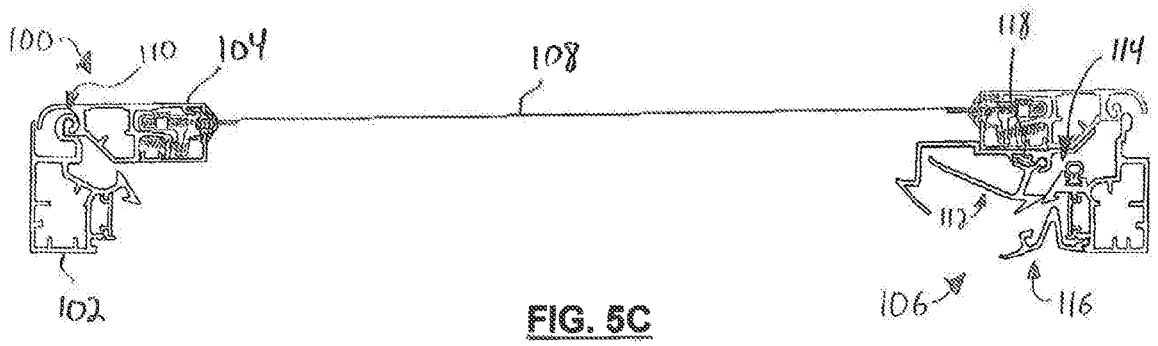
Figure 6A:
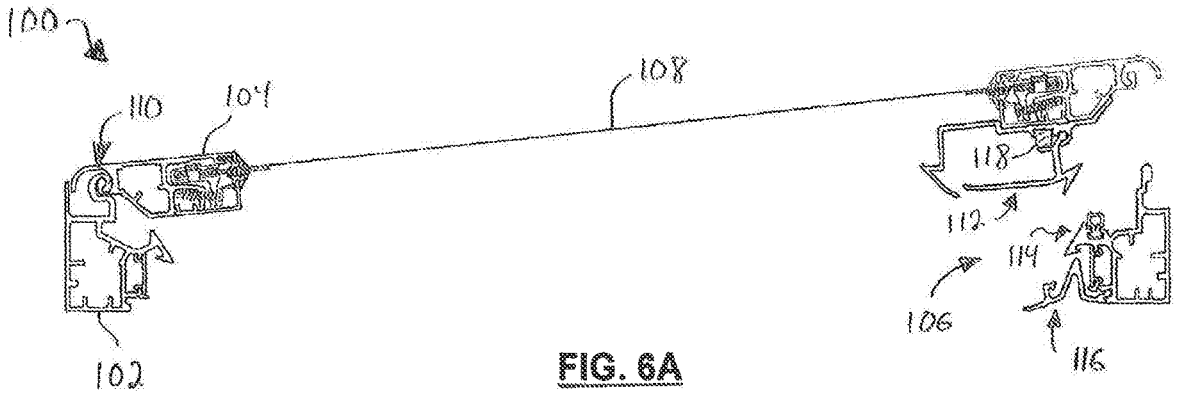
FIGS. 6A to 6D are cross-sectional views similar to that in FIG. 2A, showing closing of the emergency exit window system of FIG. 1 when the safety guard is in a disengaged position.
Figure 6B:
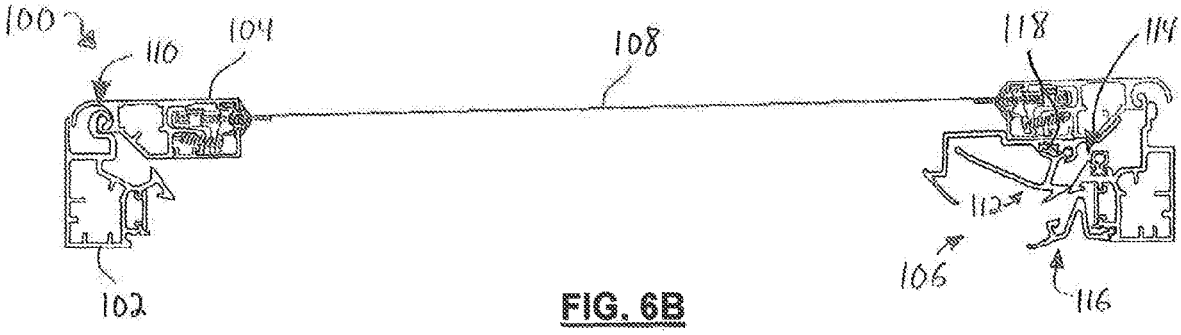
Figure 6C:
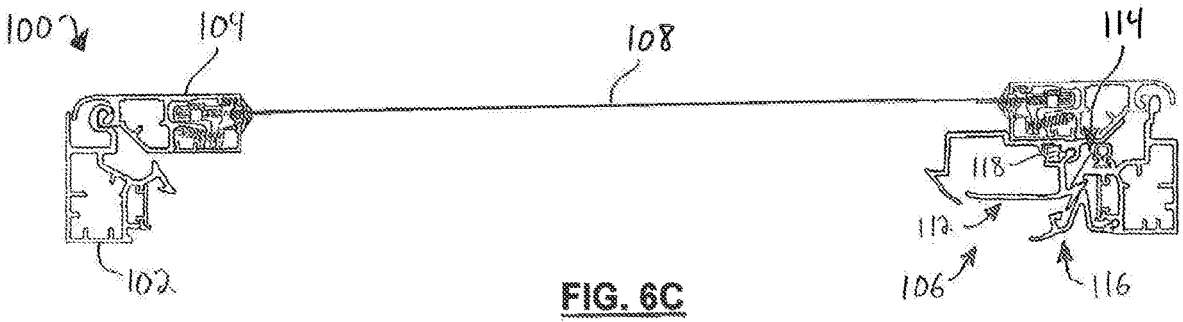
Figure 6D:
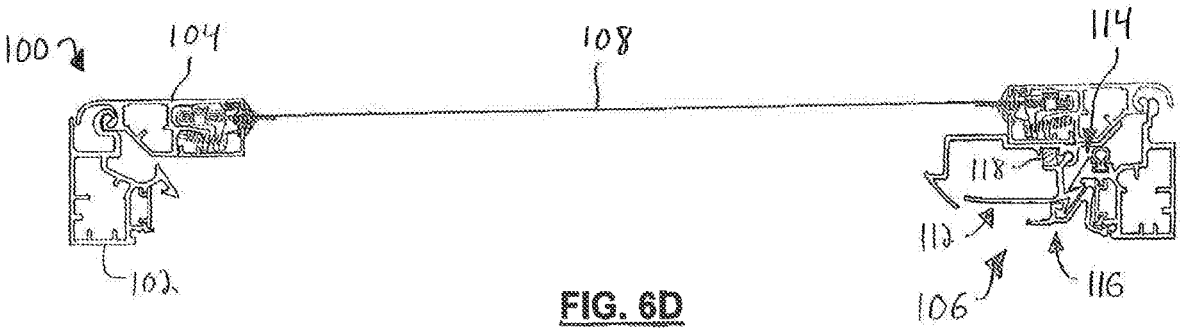
Figure 7A:
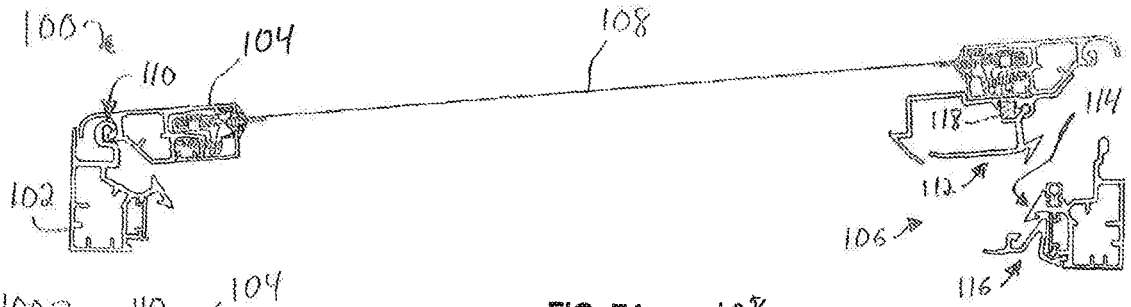
FIGS. 7A to 7F are cross-sectional views similar to that in FIG. 2A, showing closing of the emergency exit window system of FIG. 1 when the safety guard is in an engaged position.
Figure 7B:
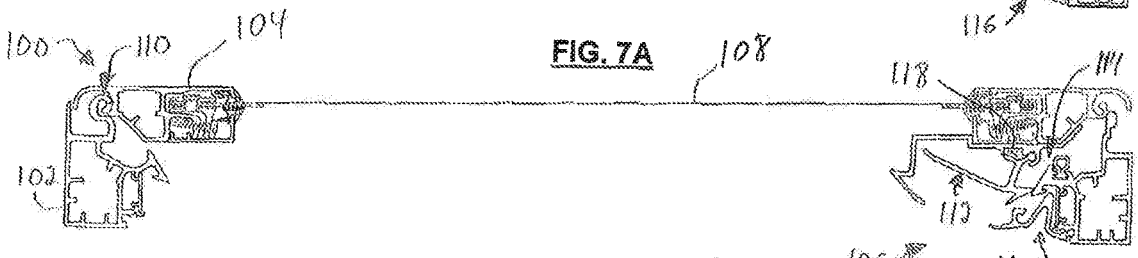
Figure 7C:
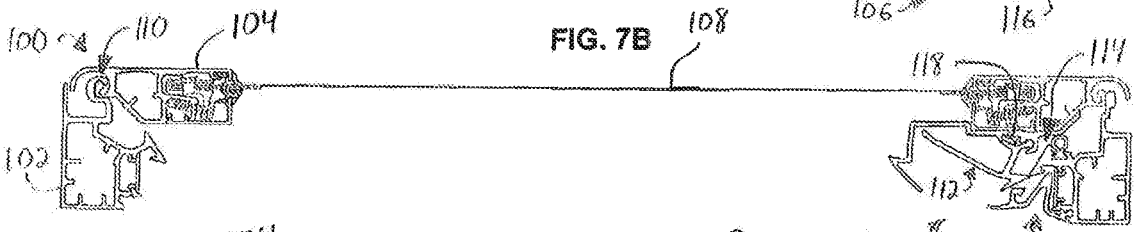
Figure 7D:
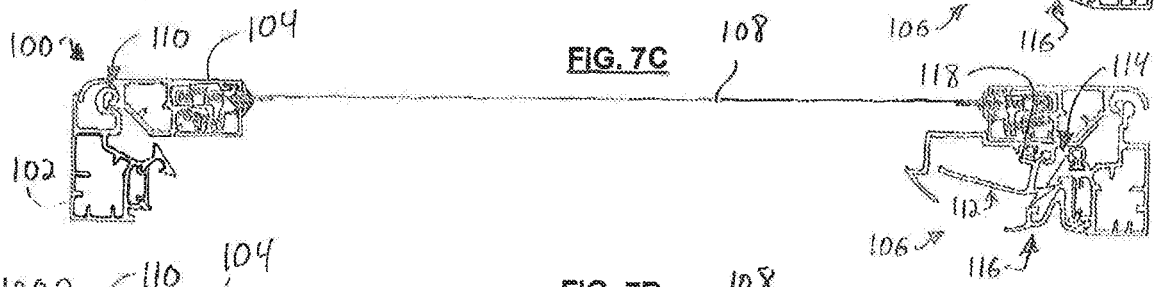
Figure 7E:
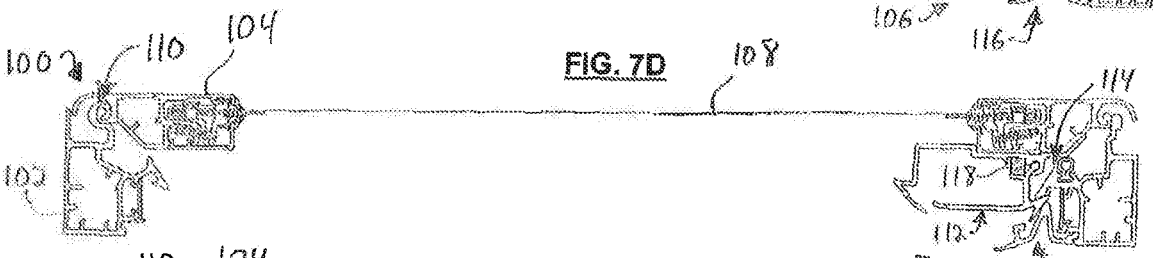
Figure 7F:
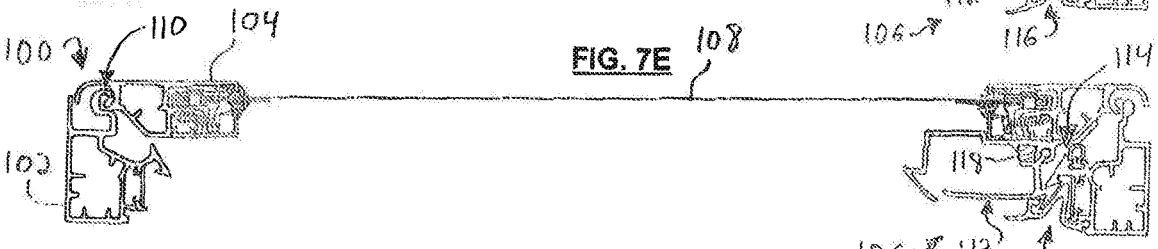

As can be seen in FIG. 3, and also in FIGS. 5A, 6D and 7F, when the sash 104 is in the closed position and the locking arm 112 is in the lock position, the locking portion 120 of the locking arm 112 is disposed interiorly of and overlaps the locking portion 140 of the locking catch 114 to obstruct pivotal movement of the sash 104 toward the open position. More particularly, the sash detent engagement surface 136 and the frame detent engagement surface 144 will engage (interfere) with one another to obstruct movement of the sash 104 from the closed position toward the open position. Conversely, when the sash 104 is in the closed position and the locking arm 112 is in the unlock position (see FIG. 5C), the locking portion 120 of the locking arm 112 is clear of the locking portion 140 of the locking catch 114 to permit pivotal movement of the sash 104 toward the open position.

Figure 4:
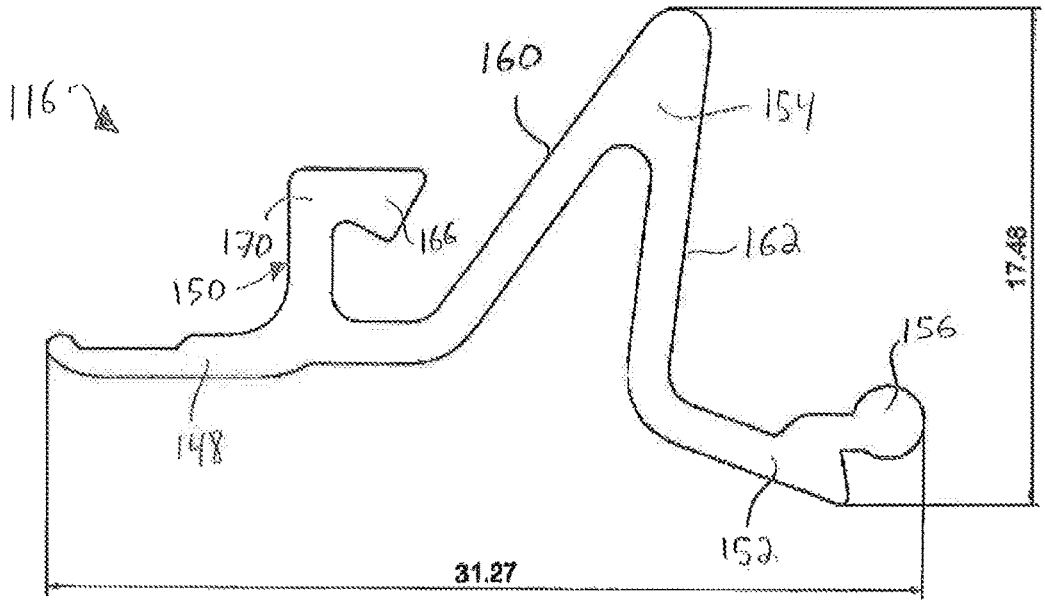
FIG. 4 is a top plan view of an exemplary safety guard according to an aspect of the present disclosure.

The safety guard 116 is movable, in this case pivotable, relative to the frame 102 between an engaged position (FIGS. 5A, 6D, 7A to 7C and 7F) and a disengaged position (FIGS. 5B to 5D, 6A to 6C, 7D and 7E). Referring now specifically to FIG. 4, the safety guard 116 includes a grip portion 148, a hook portion 150, a pin arm 152 and an exteriorly-facing hollow sphenoidal protrusion 154 disposed between the hook portion 150 and the pin arm 152. A terminal hinge pin 156 on the pin arm 152 is pivotally received in a corresponding C-shaped hinge barrel 158 on the frame 102 to allow the safety guard 116 to pivot relative to the frame 102. The sphenoidal protrusion 154 forms an inwardly-facing safety guard guide surface 160 and an outwardly-facing safety guard engagement surface 162; abutment of the safety guard engagement surface 162 against an inwardly facing sidewall 164 of the frame 102 (see FIG. 3) defines the engaged position of the safety guard 116. The hook portion 150 points toward the safety guard guide surface 160.

When the sash 104 is in the closed position and the locking arm 112 is in the lock position and the safety guard 116 is in the engaged position, the safety guard 116 obstructs movement of the locking arm 112 from the lock position into the unlock position. More particularly, in the illustrated embodiment the point 166 of the hook portion 150 is received in a chevron channel 168 formed in the sash detent 134 to trap the sash detent 135 between the hook portion 150 and the safety guard guide surface 160 and thereby trap the locking arm 112 in the lock position. When the sash 104 is in the closed position and the locking arm 112 is in the lock position and the safety guard 116 is in the disengaged position, the hook portion 150 is clear of the chevron channel 168 and therefore the safety guard 116 permits movement of the locking arm 112 from the lock position into the unlock position.

Thus, with reference now to FIGS. 5A to 5D, movement of the window system 100 from a closed configuration to an open configuration will now be described. Note that in FIGS. 5A to 5D not all features are marked with reference numerals in order to preserve clarity of illustration.

Initially, as shown in FIG. 5A, the sash 104 is in the closed position, the locking arm 112 is in the lock position, and the safety guard 116 is in the engaged position. Thus, the locking portion 120 of the locking arm 112 is disposed interiorly of and overlaps the locking portion 140 of the locking catch 114 to obstruct pivotal movement of the sash 104 toward the open position, and the safety guard 116 in turn obstructs movement of the locking arm into the unlock position.

Figure 5B:
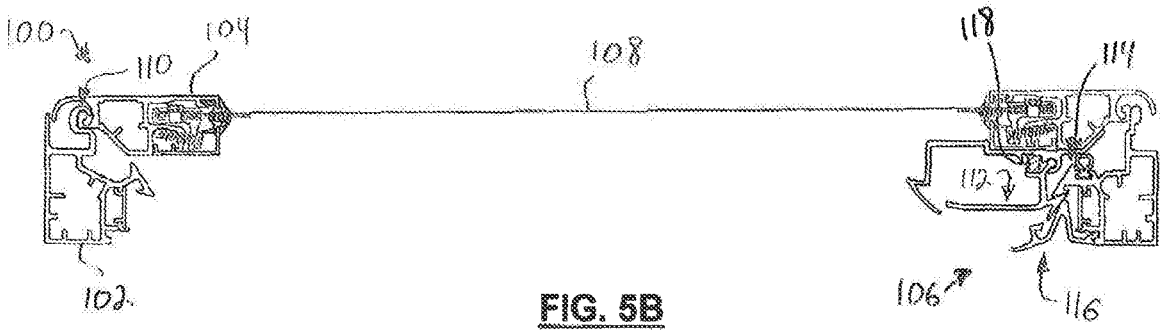
Figure 5D:
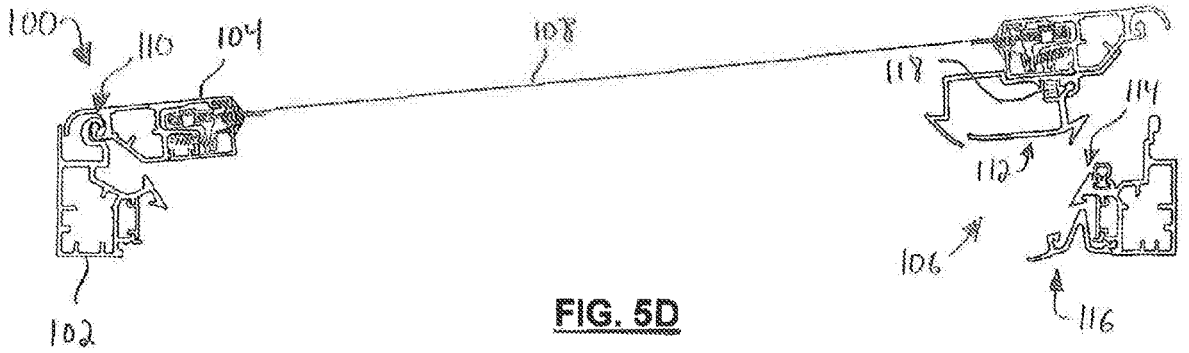

First, as shown in FIG. 5B, a user would pull the grip portion 148 of the safety guard 116 interiorly to pivot the safety guard 116 into the disengaged position. This frees the locking arm 112 to move into the unlock position. Optionally, the sphenoidal protrusion 154 may function as a living hinge to assist in moving the point 166 of the hook portion 150 out of the chevron channel 168. Next, as shown in FIG. 5C, a user would push on the handle portion 122 of the locking arm 112, which overcomes the force of the spring 118 (not shown in FIGS. 5A to 5D) and pivots the locking arm 112 into the unlock position in which it is clear of the locking catch 114. As shown in FIG. 5D, once the sash 104 has moved far enough from the closed position that the locking portion 120 of the locking arm 112 is disposed exteriorly of the locking portion 140 of the locking catch 114, even if the locking arm 112 returns to the lock position under urging from the spring 118, it will not obstruct the sash 104 from continuing to pivot into the open position.

When the sash 104 is moved to the closed position, the locking mechanism 106 will automatically lock the sash 104 in the closed position. FIGS. 6A and 7A show the sash 104 moving toward the closed position. As shown in FIGS. 6B to 6C and 7B to 7E, upon pivotal movement of the sash 104 into the closed position, the locking catch 114 acts against the locking arm 112 to urge the locking arm 112 toward the unlock position to permit the locking portion 120 of the locking arm 112 to move interiorly past the locking portion 140 of the locking catch 114 (FIG. 6B; FIGS. 7B and 7C). When the locking portion 120 of the locking arm 112 is disposed interiorly of the locking portion 140 of the locking catch 114, the locking arm 112 returns to the lock position (FIG. 6C; FIGS. 7D and 7E). More particularly, in the illustrated embodiment the sash detent guide surface 138 and the frame detent guide surface 146 engage with one another whereby the locking catch 114 acts against the locking arm 112 to urge the locking arm 112 toward the unlock position (FIG. 6B; FIGS. 7B and 7C) until the sash detent guide surface 138 clears the frame detent guide surface 146 so that the sash detent 134 is disposed interiorly of the frame detent 142. Once the sash detent 134 is disposed interiorly of the frame detent 142, the spring 118 urges the locking arm 112 back toward the lock position (FIG. 6C; FIGS. 7D and 7E).

Importantly, when the sash 104 is moved to the closed position, not only is the locking arm 112 placed in the lock position, the safety guard 116 is placed in the engaged position so as to secure the locking arm 112 in the lock position, regardless of whether the safety guard 116 started out in the engaged position or the disengaged position when the sash 104 was closed.

FIGS. 6A to 6D show movement of the sash 104 to the closed position with the safety guard 116 initially in the disengaged position. Note that to preserve clarity of illustration, in FIGS. 6A to 6D not all features are marked with reference numerals.

With the safety guard 116 in the disengaged position when the sash 104 moves into the closed position, the locking arm 112 acts on the safety guard 116 to move the safety guard 116 into the engaged position. More particularly, in the illustrated embodiment, if the safety guard 116 is in the disengaged position when the sash detent guide surface 138 clears the frame detent guide surface 146, movement of the locking arm 112 into the lock position after the locking arm 112 clears the frame detent guide surface 146 causes the sash detent guide surface 138 to engage the safety guard guide surface 160 and move the safety guard 116 into the engaged position. This is shown in FIGS. 6C and 6D.

FIGS. 7A to 7F show movement of the sash 104 to the closed position with the safety guard 116 initially in the engaged position. Note that in FIGS. 7A to 7F not all features are marked with reference numerals in order to preserve clarity of illustration.

If the safety guard 116 is in the engaged position when the sash 104 moves into the closed position, as the locking portion 120 of the locking arm 112 moves interiorly past the locking portion 140 of the locking catch 114, the locking arm 112 first acts on the safety guard 116 to move the safety guard 116 out of the engaged position (FIG. 7D) until the locking portion 120 of the locking arm 112 is disposed interiorly of the locking portion 140 of the locking catch 114 (FIG. 7D), and then the locking arm 112 further acts on the safety guard 116 to return the safety guard 116 to the engaged position (FIGS. 7E to 7F). More particularly, as the locking portion 120 of the locking arm 112 moves interiorly past the locking portion 140 of the locking catch 114, the sash detent guide surface 138 engages the bend 170 of the hook portion 150 to move the safety guard 116 into the disengaged position (FIG. 7D). Then, as the locking arm 112 returns to the lock position, the sash detent guide surface 138 engages the safety guard guide surface 160 (FIG. 7E) to move the safety guard 116 into the engaged position (FIG. 7F).

One or more currently preferred embodiments have been described by way of example. Any dimensions shown in the drawings are merely exemplary and are not intended to be limiting. It will be apparent to persons skilled in the art that a number of variations and modifications can be made without departing from the scope of the claims.

What is claimed is:

1. An emergency exit window system, comprising:

a frame;

a sash pivotally carried by the frame so as to pivot between:

a closed position in which the sash is flush with the frame; and an open position permitting human egress through the frame;

a locking mechanism adapted for locking the window sash in the closed position, the locking mechanism comprising:

a locking arm movably carried by the sash, wherein:

the locking arm is movable relative to the sash between a lock position and an unlock position; and at least one biasing member acts between the locking arm and the sash to bias the locking arm toward the lock position;

an inwardly projecting locking catch fixedly carried by the frame; and an inwardly projecting safety guard movably carried by the frame, wherein:

the safety guard is movable relative to the frame between an engaged position and a disengaged position;

wherein:

upon pivotal movement of the sash into the closed position, the locking catch acts against the locking arm to urge the locking arm toward the unlock position to permit a locking portion of the locking arm to move interiorly past a locking portion of the locking catch;

when the locking portion of the locking arm is disposed interiorly of the locking portion of the locking catch, the locking arm returns to the lock position;

and wherein:

when the sash is in the closed position and the locking arm is in the lock position, the locking portion of the locking arm is disposed interiorly of and overlaps the locking portion of the locking catch to obstruct pivotal movement of the sash toward the open position; and when the sash is in the closed position and the locking arm is in the unlock position, the locking portion of the locking arm is clear of the locking portion of the locking catch to permit pivotal movement of the sash toward the open position;

and wherein:

when the sash is in the closed position and the locking arm is in the lock position and the safety guard is in the engaged position, the safety guard obstructs movement of the locking arm from the lock position into the unlock position; and when the sash is in the closed position and the locking arm is in the lock position and the safety guard is in the disengaged position, the safety guard permits movement of the locking arm from the lock position into the unlock position;

and wherein:

if the safety guard is in the disengaged position when the sash moves into the closed position, the locking arm acts on the safety guard to move the safety guard into the engaged position.

2. The window system of claim 1, wherein:

if the safety guard is in the engaged position when the sash moves into the closed position, as the locking portion of the locking arm moves interiorly past the locking portion of the locking catch, the locking arm first acts on the safety guard to move the safety guard out of the engaged position until the locking portion of the locking arm is disposed interiorly of the locking portion of the locking catch, and then the locking arm further acts on the safety guard to return the safety guard to the engaged position.

3. The window system of claim 2, wherein:

the locking portion of the locking arm includes a terminal sash detent that is generally sagittate in cross-section;

the sash detent has a sash detent guide surface on an interior side thereof;

the safety guard has an exteriorly-facing sphenoidal protrusion, wherein the sphenoidal protrusion forms an inwardly-facing safety guard guide surface;

and wherein the locking arm acts on the safety guard to return the safety guard to the engaged position by engagement of the sash detent guide surface with the safety guard guide surface.

4. The window system of claim 3, wherein:

the sphenoidal protrusion forms an outwardly-facing safety guard engagement surface; and abutment of the safety guard engagement surface against a sidewall of the frame defines the engaged position of the safety guard.

5. The window system of claim 4, wherein:

the safety guard includes a hook portion pointing toward the safety guard guide surface;

when the sash is in the closed position and the locking arm is in the lock position and the safety guard is in the engaged position:

the point of the hook portion is received in a chevron channel formed in the sash detent to trap the sash detent between the hook portion and the safety guard guide surface and thereby trap the locking arm in the lock position.

6. A window system, comprising:

a frame;

a sash pivotally carried by the frame so as to pivot between:

a closed position in which the sash is flush with the frame; and an open position permitting egress through the frame;

a locking mechanism adapted for locking the window sash in the closed position, the locking mechanism comprising:

a locking arm pivotally carried by the sash, wherein:

the locking arm is pivotable relative to the sash between a lock position and an unlock position;

at least one biasing member acts between the locking arm and the sash to bias the locking arm toward the lock position;

the locking arm has a sash detent at an outer end thereof;

the sash detent has a sash detent engagement surface on an exterior side thereof and has a sash detent guide surface on an interior side thereof; and an inwardly projecting locking catch fixedly carried by the frame, wherein:

the locking catch has a frame detent at an inner end thereof; and the frame detent has a frame detent engagement surface on an interior side thereof and has a frame detent guide surface on an exterior side thereof; and an inwardly projecting safety guard pivotally carried by the frame, wherein:

the safety guard is pivotable relative to the frame between an engaged position and a disengaged position;

wherein:

upon pivotal movement of the sash into the closed position:

the sash detent guide surface and the frame detent guide surface engage with one another whereby the locking catch acts against the locking arm to urge the locking arm toward the unlock position until the sash detent guide surface clears the frame detent guide surface so that the sash detent is disposed interiorly of the frame detent;

once the sash detent is disposed interiorly of the frame detent, the at least one biasing member urges the locking arm toward the lock position; and when the locking arm is in the lock position, the sash detent overlaps the frame detent to obstruct pivotal movement of the sash toward the open position by engagement of the sash detent engagement surface with the frame detent engagement surface; and when the sash is in the closed position and the locking arm is in the unlock position, the locking portion of the locking arm is clear of the locking portion of the locking catch to permit pivotal movement of the sash toward the open position;

and wherein:

when the sash is in the closed position and the locking arm is in the lock position and the safety guard is in the engaged position, the safety guard obstructs movement of the locking arm from the lock position into the unlock position; and when the sash is in the closed position and the locking arm is in the lock position and the safety guard is in the disengaged position, the safety guard permits movement of the locking arm from the lock position into the unlock position;

characterized in that:

the safety guard has a safety guard guide surface; and if the safety guard is in the disengaged position when the sash detent guide surface clears the frame detent guide surface, movement of the locking arm into the lock position after the locking arm clears the frame detent guide surface causes the sash detent guide surface to engage the safety guard guide surface and move the safety guard into the engaged position.

* * * * *